US007201653B2

(12) United States Patent
Radom

(10) Patent No.: US 7,201,653 B2
(45) Date of Patent: Apr. 10, 2007

(54) BOOK OF WISHES GAME

(76) Inventor: Benny Radom, 39, Reding st., Tel-Aviv 69028 (IL)

( * ) Notice: Subject to any disclaimer, the term of this patent is extended or adjusted under 35 U.S.C. 154(b) by 186 days.

(21) Appl. No.: 09/948,122

(22) Filed: Sep. 6, 2001

(65) Prior Publication Data

US 2002/0098881 A1 Jul. 25, 2002

Related U.S. Application Data

(60) Provisional application No. 60/230,769, filed on Sep. 7, 2000.

(51) Int. Cl.
*A63F 13/00* (2006.01)
*A63F 9/24* (2006.01)

(52) U.S. Cl. ..... 463/9

(58) Field of Classification Search ..... 463/1, 463/9, 40, 42, 43; 273/429–432, 243; 700/90–92; 434/322–364; 705/1, 7, 10, 14–17, 24, 26–27
See application file for complete search history.

(56) References Cited

U.S. PATENT DOCUMENTS 5,403,014 A * 4/1995 Anema et al. ..... 273/292
5,537,143 A * 7/1996 Steingold et al. ..... 725/119
5,545,088 A * 8/1996 Kravitz et al. ..... 463/40
5,695,400 A * 12/1997 Fennell et al. ..... 463/42
5,813,913 A * 9/1998 Berner et al. ..... 463/40
5,936,661 A * 8/1999 Trew ..... 725/114
5,992,853 A * 11/1999 Rudell et al. ..... 273/287
6,074,299 A * 6/2000 Cohen ..... 463/42
6,155,838 A * 12/2000 Hyman et al. ..... 434/322
6,174,237 B1 * 1/2001 Stephenson ..... 463/42
6,193,610 B1 * 2/2001 Junkin ..... 463/40
6,267,379 B1 * 7/2001 Forrest et al. ..... 273/431
6,306,035 B1 * 10/2001 Kelly et al. ..... 463/25
6,439,997 B1 * 8/2002 Brasseur et al. ..... 463/40

(Continued)

OTHER PUBLICATIONS

A Salute to Game Shows—The Price is Right—Pricing Games—Three Strikes Game, p. 8 of 9, [online], Retrieved on Aug. 16, 2000. Retrieved from the Internet <URL:http://ben-schumin.simplenet.com/game-shows/shows/price-is-right/pricing-games-4.htm>.*

(Continued)

*Primary Examiner*—Robert P. Olszewski
*Assistant Examiner*—Dat Nguyen
(74) *Attorney, Agent, or Firm*—Reed Smith LLP; Stanley P. Fisher, Esq.; Juan Carlos A. Marquez, Esq.

(57) ABSTRACT

A method for playing a game in which one or more contestants endeavor to transform a list of personal desired wishes into awarded prizes. The game offers two mechanisms-knowledge version and luck version for realizing these wishes. External participants may become involved in the game and fulfill their own personally selected wishes. The external participants may obtain the unfulfilled wishes lost by the contestants. In a preferred embodiment of the present invention a website "arena" is provided, which uniquely connects personal needs and desires of individuals with potential suppliers of these desired products and services. The arena enables participants to accumulate credit points. The game—typically a TV game show—stimulates the general public to take part in the arena, promotes it, and creates a competitive advantage over e-commerce sites.

48 Claims, 3 Drawing Sheets

U.S. PATENT DOCUMENTS

| | | | | |
|---|---|---|---|---|
| 6,447,396 | B1 * | 9/2002 | Galyean et al. | 463/40 |
| 6,565,084 | B1 * | 5/2003 | Katz et al. | 273/138.1 |
| 6,749,198 | B2 * | 6/2004 | Katz et al. | 273/138.1 |
| 2001/0036865 | A1 * | 11/2001 | Neal, III | 463/42 |
| 2002/0004424 | A1 * | 1/2002 | Nelson et al. | 463/42 |
| 2002/0013174 | A1 * | 1/2002 | Murata | 463/42 |
| 2002/0034980 | A1 * | 3/2002 | Lemmons et al. | 463/40 |
| 2003/0013528 | A1 * | 1/2003 | Allibhoy et al. | 463/42 |

OTHER PUBLICATIONS

Merriam-Webster's Collegiate Dictionary, Tenth Edition, 1998, p. 250.*

The Price is Right Grocery Game, 1972, [online], [retrieved Oct. 16, 2003]. Retrieved from the Internet: <<http://gscentral.net/grocery.htm>.>.*

Punch-a-Bunch/The Punch Board, 1978, [online], [retrieved Sep. 17, 2002]. Retrieved from the Internet: <<http://gscentral.net/punch.htm>.>.*

The Price is Right Grand Game, 1980, [online], [retrieved Oct. 16, 2003], Retrieved from the internet: <<http://gscentral.net/grand.htm>.>.*

The Price is Right It's in the Bag Game, 1997, [online], [retrieved Oct. 16, 2003], Retrieved from the Internet: <<http://gscentral.net/bag.htm>.>.*

* cited by examiner

BOOK OF WISHES GAME

The present invention relates to a provisional application Ser. No. 60/230,769 applied to the United States Patent and Trademark Office on 7 Sep. 2000. and this application claims the benefit and priority of this U.S. Provisional Patent Application No. 60/230,769, filed on Sep. 7, 2000, under 35 U.S.C. § 119 and 35 U.S.C. § 120.

FIELD OF THE INVENTION

The present invention is related to games. More particularly, the present invention is related to a book of wishes game based on either luck or knowledge, in which external participants may play through a communication network. The present invention is also related to commerce and method of marketing products and services that combine TV gaming and communication networks.

BACKGROUND OF THE INVENTION

Television prime time games have regained their popularity in the last couple of years. Most of the games are for pure entertainment, but some of the games are based on knowledge and have an educational component as well. Some of the games include other skills such as quickness or acting ability. A contestant's reaction time or other required skills might enable him to receive a prize for winning that game. There are not many games that are based on pursuing a personal dream or a wish, where the prizes are based on personal wishes desired by the contestants. To the best of the inventor's knowledge, there are no games in which prizes that are lost by TV contestants are transferred to web users.

SUMMARY OF THE INVENTION

It is an object of the present invention to provide a method for a new game in which wishes of contestants are fulfilled according to their knowledge. The wishes are recorded is a book of wishes.

It is another object of the present invention to provide a method for a new game in which wishes of contestants are fulfilled according to their luck. The wishes are recorded in a book of wishes.

It is yet another object of the present invention to provide a new and unique game in which prizes that are lost by the contestants in the game are transferred to web users. The web users register to participate in the book of wishes game prior to the beginning of the game and may receive prizes after the actual game with the contestants is over.

It is an additional object of the present invention to provide an Internet site in which Internet users may present their wishes and collect information from the business world on how to achieve their wishes. In addition, the web users are involved in as many activities in the Internet site and in this way increase the odds of receiving their personal wishes. The Internet site is a location in which web users may register themselves in order to win prizes that were lost by contestants in a book of wishes game that is played on television.

It is thus provided a method for playing a game comprising at least one of a plurality of contestants, a predetermined number of desired prizes over which the contestants are contesting, the desired prizes are listed by each contestant and are ordered according to a predetermined order, the game further comprises a plurality of external participants who contests the prizes that the contestants fail to win, said method comprising:

listing a set of wanted prizes, wherein each of the external participants indicates at least one wanted prize;

challenging one of the contestants to answer at least one of a set of questions, wherein the number of questions in the set of questions is at least as the predetermined number of desired prizes and wherein the questions are distributed among a plurality of topics;

crediting one prize from the desired prizes listed by the contestant to the contestant according to the predetermined order upon providing a right answer for each one of the set of questions;

discrediting the credited prizes upon providing a wrong answer for one of the set of questions;

transferring credited prizes to the contestant;

transferring discredited prizes and prizes that the contestant failed to win to the external participants.

Furthermore, in accordance with another preferred embodiment of the present invention, said plurality of external participants is participating in the game over a communication network.

Furthermore, in accordance with another preferred embodiment of the present invention, said communication network is an Internet web.

Furthermore, in accordance with another preferred embodiment of the present invention, the discredited prizes are transferred to the external participant if their wanted prize corresponds with the desired prize to be transferred.

Furthermore, in accordance with another preferred embodiment of the present invention, said method further comprises screening the contestants so that at least one contestant is challenged.

Furthermore, in accordance with another preferred embodiment of the present invention, screening the contestants is performed by asking trivia questions.

Furthermore, in accordance with another preferred embodiment of the present invention, the contestant can choose a topic from which a question is selected in order to challenge the contestant.

Furthermore, in accordance with another preferred embodiment of the present invention, said method further comprises insuring a credited prize by canceling one topic from the topics.

Furthermore, in accordance with another preferred embodiment of the present invention, said method further comprises providing a limited time after a question was asked, and wherein the contestant can choose not to answer the question during said limited time, and wherein the contestant is not discredited from credited prizes and continues to the next question.

It is further provided a method for playing a game comprising at least one of a plurality of contestants, a predetermined number of desired prizes over which the contestants are contesting, the desired prizes are listed by each contestant and are ordered according to a predetermined order, the game further comprises a plurality of external participants who contests the prizes that the contestants fail to win, said method comprising:

listing a set of wanted prizes, wherein each of the external participants indicate one wanted prize;

providing a container, said container is adapted to hold at least one golden ball and at least one black ball;

challenging one of the contestants to pull a ball from said container;

crediting one prize from the desired prizes listed by the contestant to the contestant according to the predetermined order upon pulling a golden ball from said at least one golden ball;

discrediting the credited prizes upon pulling a black ball from said at least one black ball;

transferring credited prizes to the contestant;

transferring discredited prizes and prizes that the contestant failed to win to the external participants.

Furthermore, in accordance with another preferred embodiment of the present invention, said plurality of external participants is participating in the game over a communication network.

Furthermore, in accordance with another preferred embodiment of the present invention, said communication network is an Internet web.

Furthermore, in accordance with another preferred embodiment of the present invention, the discredited prizes are transferred to the external participants if their wanted prize corresponds with the desired prize to be transferred.

Furthermore, in accordance with another preferred embodiment of the present invention, said method further comprises screening the contestants so that at least one contestant is challenged.

Furthermore, in accordance with another preferred embodiment of the present invention, screening the contestants is performed by asking trivia questions.

Furthermore, in accordance with another preferred embodiment of the present invention, the contestant can choose to be challenges to answer a trivia question so that if the answer to the question is correct, an additional golden ball is inserted into said container.

Furthermore, in accordance with another preferred embodiment of the present invention, said method further comprises insuring a credited prize by addition of a black ball into said container.

It is also provided a method for allowing an external participant to connect to a server of an Internet site for participating in a game that comprises at least one of a plurality of contestants, a predetermined number of desired prizes over which the contestants are contesting, in order to contest over the prizes that the contestants fail to win, said method comprising:

providing an interface for connecting the external participant to the server;

providing a file in which the external participant may submit data to said internet site, wherein said data comprises a wanted prize;

providing an interface for connecting the game to said server in order to transfer the prizes the contestants failed to win to the external participant;

whereby after the contestants of the game failed to win prizes, desired prizes that are lost are transferred to an external participant that submitted a corresponding wanted prize.

Furthermore, in accordance with another preferred embodiment of the present invention, said method further comprises generating an external participant's file on said server for each of the external participants, said external participant's file includes all activities of the external participant in said Internet site.

Furthermore, in accordance with another preferred embodiment of the present invention, said external participant's file further contains an accumulation of credit points that are credited on behalf of the external participant for each participation in the Internet site's activities.

Furthermore, in accordance with another preferred embodiment of the present invention, additional credit points increase the odds of the external participants to receive wanted prizes.

Furthermore, in accordance with another preferred embodiment of the present invention, lottery of the lost desired prizes is set up between the external participants.

Additionally, it is further provided a method for facilitating interaction between suppliers and web users, said method comprising:

providing a web site;

providing an interface for connecting the web users to the web site, wherein the web users submit a request for a prize to the web site;

providing an interface for connecting the suppliers to the web site, wherein said suppliers transfer business information to the web users and wherein the information involves means for achieving said prize;

providing a television game in which contestants are contesting for prizes, wherein the television game is a source for prizes;

transferring prizes that the contestants in the television game failed to win to the web users.

Furthermore, in accordance with another preferred embodiment of the present invention, said web site is an Internet site.

Furthermore, in accordance with another preferred embodiment of the present invention, said web site is ITV.

Furthermore, in accordance with another preferred embodiment of the present invention, the method further comprises providing a user file in which all activities of the user in the site are registered.

Furthermore, in accordance with another preferred embodiment of the present invention, registration of activities in the user file credits the user with credit points and wherein credit points increase the odds of the web user to achieve a prize.

DETAILED DESCRIPTION OF THE INVENTION AND FIGURES

The book of wishes game in accordance with a preferred embodiment of the present invention is preferably divided into two parts. One part of the book of wishes game is the actual game that involves contestants and is recorded and may be viewed by television viewers on line. In the actual game, prizes are provided to contestants playing the game, while the prizes are based on the wishes of the contestants themselves. The wishes of the contestants are recorded into a book of wishes prior to the actual beginning of the game. In the other part of the game, wishes that are not received by the contestants due to failure to win them, are transferred to external participants that may preferably be web users that register to participate in the book of wishes game prior to the beginning of the actual game. An Internet site component is uniquely integrated into the two parts of the game mechanism.

In one concept of the book of wishes game, the game is based on the knowledge of the contestants. The contestants have to answer knowledge questions such as in trivia games. The contestants are rewarded for answering the right answer according to the list of wishes in their book of wishes.

Figure 1:
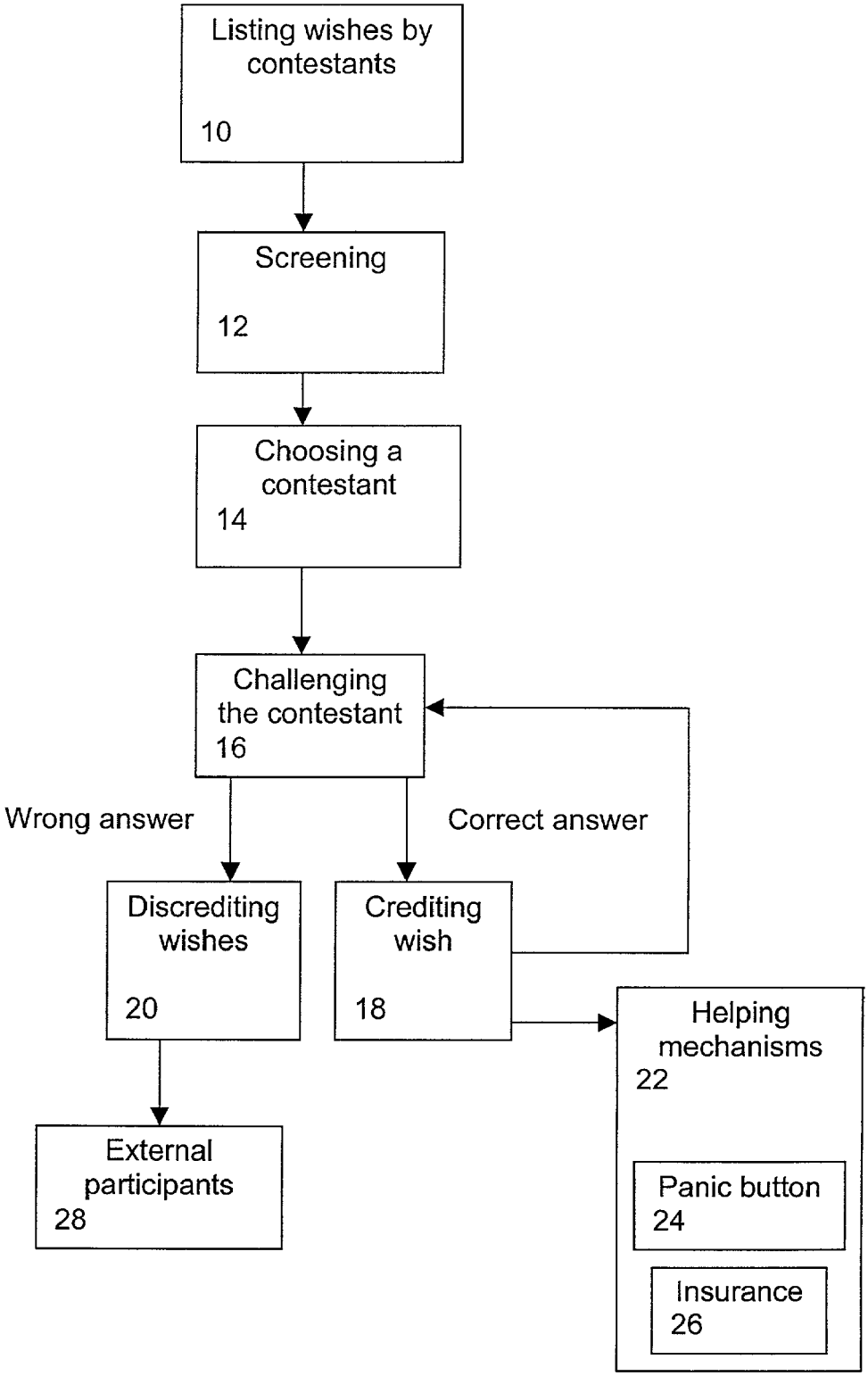
FIG. 1 illustrates a block diagram of stages in a book of wishes game in accordance with a preferred embodiment of the present invention.

Reference is now made to FIG. 1 illustrating a block diagram of stages in a book of wishes game in accordance with a preferred embodiment of the present invention. In the first stage 10, the contestants are listing their wishes. The wishes have to be of material nature such as products or services that may be attained by the organizers of the game. For example, cars, television sets, vacation or meeting with a celebrity. The number of wishes is predetermined and the wishes are preferably sorted according to their monetary value, from the least expensive one, listed as wish no. 1, to the most expensive one, listed as the $10^{th}$ wish, for example. Each contestant is provided with a personal book of wishes that corresponds to his or her own personal wishes or dreams. The books are prepared according to the wishes of the contestants prior to the beginning of the actual game.

At least two, but preferably six, contestants are sited while holding their own book of wishes. A personal camera that is continuously pointed towards a contestant tapes the contestant. Each contestant is preferably provided with a board, on which buttons are provided. The buttons are connected to a control system and are adapted to transfer instructions or answers from the contestants to the organizers of the game.

As mentioned herein before, the book of wishes game is preferably filmed and shown on television. The pictures of the contestants are shown simultaneously on a monitor divided into several parts; each of the parts presents an on-line picture of one of the contestant so that all contestants may be view on the monitor; hence on television at the same time.

In stage 12 of the game, the contestants go through a screening process in which a host asks them preferably three multiple-choice questions. After the first question asked, the contestants transfer their answers by pushing a button on the provided board. The answers of the contestants are preferably shown on the monitor. After revealing the answers of the contestants, the contestants that gave the wrong answers must leave the game. The same procedure is repeated for the second and third questions. Again, after the contestants transfer their answers by pushing a button, the answers are revealed on a separate section on the monitor. The contestants that failed answering the right answers are removed from the game.

Let's assume that in the specific game described herein as an example, two contestants answered all three questions correctly. Stage 14 involves choosing the first contestant that will be challenged. The contestants will be rated preferably according to their accumulated reaction time. The contestant that plays the first is the contestant who has the minimum accumulated reaction time. The faster contestant approaches the center of a stage and hand over his own book of wishes to the host.

The host in stage 16 challenges the first contestant. At this point, the contestant is presented with a plurality but preferably 14 different topics, from which he may choose one. The first question will involve the chosen topic.

A multiple-choice question on the chosen topic is presented and the contestant answers the question. If the answer is correct, the first wish from the contestant's book of wishes is credited on behalf of the contestant (stage 18). In a similar way, the contestant may choose another topic and trade correct answers for the wishes in his own book of wishes. The host is provided with stamps or any other item indicating a wish is credited. When the contestant answers correctly, the host preferably stamps the wish with a special figured stamp. Upon giving a wrong answer, the contestant is discredited 20 from all credited prizes won so far.

It is optional to provide helping mechanisms 22 to the contestant in order to assist him in winning at least one or some of his prizes. A panic button 24 is provided. The panic button is active for preferably 10 seconds after the question was asked. During these 10 seconds, the contestant may decide if he wishes to answer this specific question or move to another topic. The penalty the contestant pays for pushing the panic button is losing the topic. The contestant may push the panic button as many times as he needs, but each time, he loses a topic. As a result, the contestant may lose too many topics and fail to have enough questions on which he may trade a correct answer for a wish from his book of wishes.

At this point of the game, the monitor showing the book of wishes game is divided into a few sections. The picture of the contestant is in the middle of the screen. On the sides, there is a list of credited wishes and topics, including topics cancelled due to pushing the panic button. At this point of the game, another contestant helping mechanism 22 may be used, the insurance 26. Since the contestant, as mentioned herein before, loses all his credited wishes for providing a wrong answer, he may insure a credited wish. Each insured wish equals the loss of one topic. Any other proportion is also covered by the scope of the present invention. The contestant may insure one of his wishes against one topic that is cancelled from the list of topics. The contestant preferably may insure as many wishes as he wants at the cost of topics, but, again, he should make sure that enough topics are left in order to fulfill wishes that remain in his book of wishes.

One of the unique features of the book of wishes game of the present invention is the participation of viewers, external participants 28, preferably through the Internet web or ITV. The external participants may use any other communication web such as a telephone network. The registration of the external participants in the game is performed prior to the actual game, in an off-line participation site. Wishes that are lost by contestants due to wrong answers are transferred to these external participants. External (preferably Internet) participants may enter the book of wishes game web site and list their own wishes, hoping their wish comes through.

Figure 2:
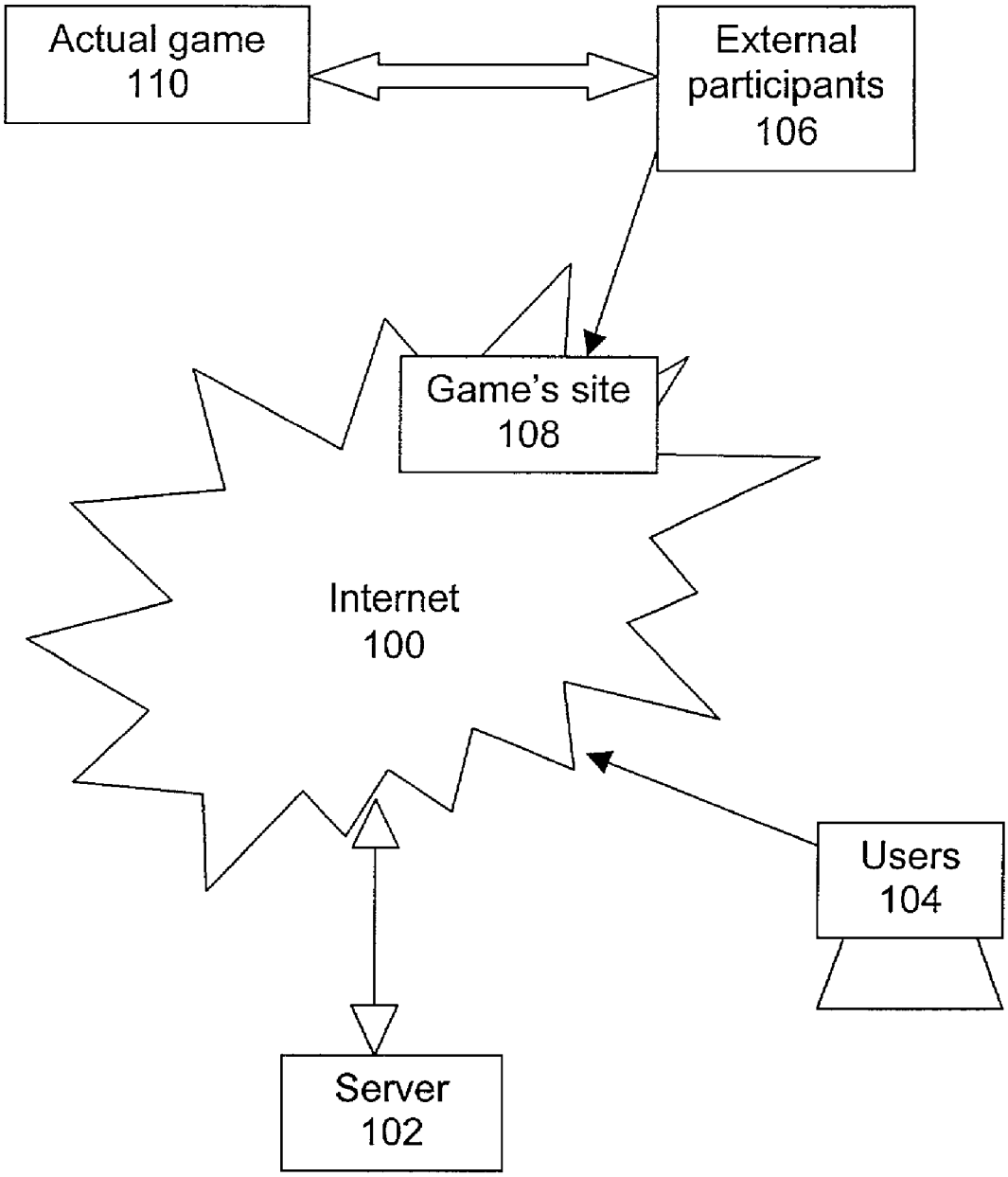
FIG. 2 illustrates a schematic diagram of a communication network in accordance with a preferred embodiment of the present invention, through which external participants in a book of wishes game can connect to the actual game.

Reference is now made to FIG. 2, illustrating a schematic diagram of a communication network in accordance with a preferred embodiment of the present invention, through which external participants of a book of wishes game can connect to the actual game. As mentioned herein before, the game has two parts, an actual game that may be viewed on television and a part that is partially played through a communication web, preferably an Internet web 100. The Internet participation is performed through a book of wishes game web site 108 that is located in a server 102 and may be connected to through the Internet 100. External participants 106 are connected through their computers to the Internet 100 and are provided with many different activities in web site 108. When external participants 106 are interacting with the activities in the web site, they accumulate credit points that will eventually increase their odds to win prized that are lost in the book of wishes actual game. External participants 106 as well as other web users 104 that are interacting in the Internet web may submit wishes through the game's web site. Game web site 108 may comprise a catalog of wishes that accord with some of the wishes of external participants 106 and the external participants may submit wishes from the catalog or submit wishes from their own. The prizes that were lost in the actual game are distributed among the external participants in accordance with their own wishes as they stated upon registration. If there are some external participants who are entitled to the same prize, the participant who has accumulated the most credit points in various activities in the web site increases his odds of winning the prize. Credit points are accumulated by activities such as revisiting the web site, solving puzzles and trivia quizzes, and agreeing to receive commercial information and special offers regarding items on the participants' wish lists. A lottery may be held in order to distribute the prizes that have been lost in the actual television game.

After this part of the game is over, it is optional to allow the studio audience to participate in the game. Scratch cards are dropped from the studio ceiling above the audience. Only one of the cards is marked with the winning symbol, and the person who catches this card is entitled to win the wish he chose prior to the start of the show taping.

In another aspect of the present invention, the book of wishes game is based on luck rather than knowledge. The question asked in the first screening of the contestants are yes/no questions and the contestants board is provided with two colored buttons representing yes or no answers. The basic concept in these first stages of the game is similar to the previous one based on knowledge.

Figure 3:
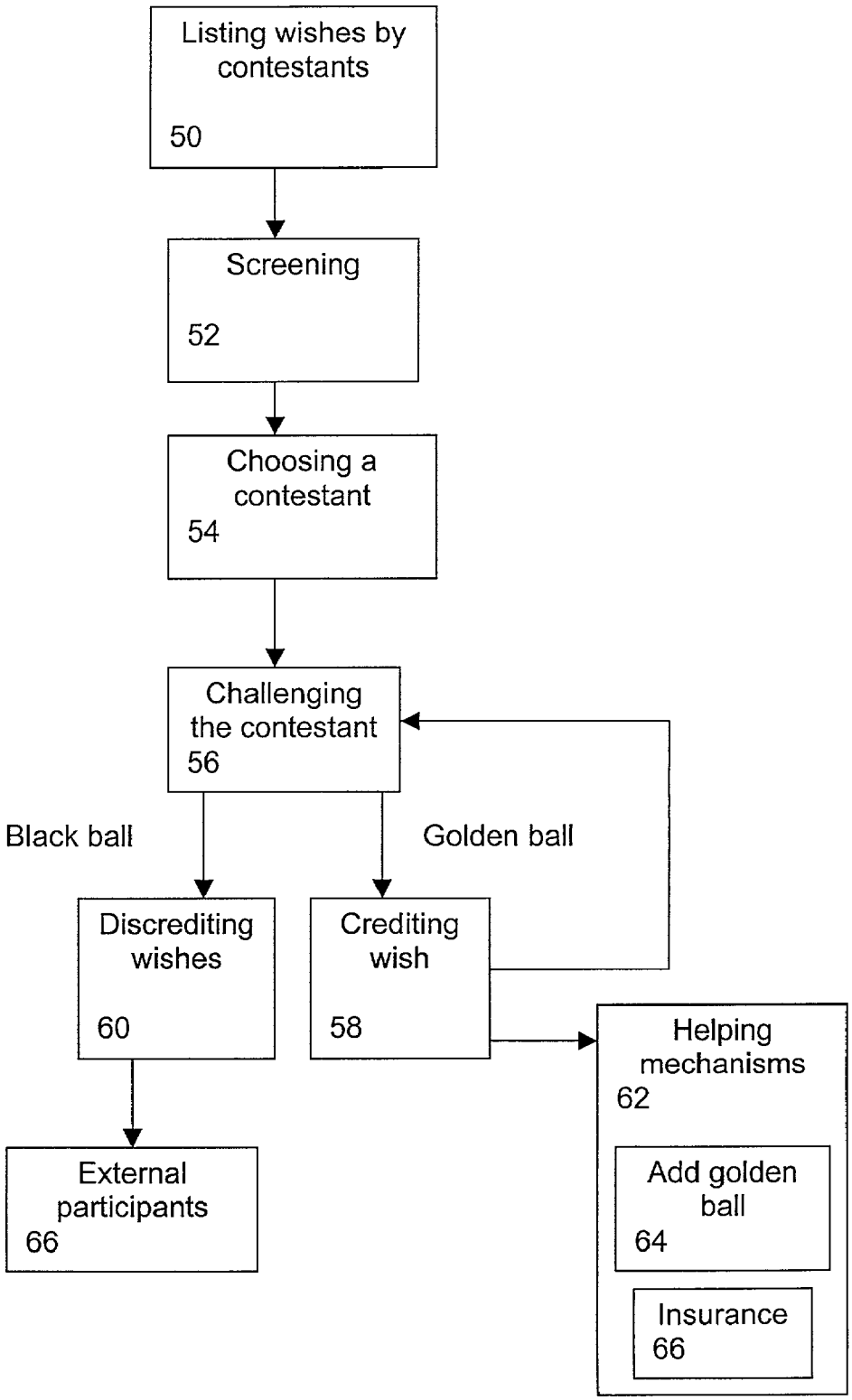
FIG. 3 illustrates a block diagram of stages in a book of wishes game in accordance with another preferred embodiment of the present invention.

Reference is now made to FIG. 3 illustrating a block diagram of stages in a book of wishes game in accordance with another preferred embodiment of the present invention. After listing wishes 50 and screening the contestants 52, the faster contestant is chosen 54 and approaches the host in the center of the stage.

The contestant that answered faster than the others approaches a host and both of them are standing behind a podium. A dome is provided preferably on top of the podium. The lower part of the dome is preferably transparent and the upper part is opaque. Near the dome, a cylinder filled with preferably 10 golden balls is provided. Each ball represents one wish. Since the contestant in this case answered correctly in the beginning of the game four questions, four golden balls are placed inside the dome together with one black ball; the black ball is identical in size and texture to the golden balls.

The contestant is now challenged 56 to reach his hand into the dome and to pull out one ball. For pulling a golden ball, the contestant is credited with a wish 58, but, if he pulls out a black ball, the book of wishes game is over for him and all wishes are discredited 60. The odds for pulling a golden ball are at the beginning 4/1. The contestant is again provided with helping mechanisms 62. The first is increasing his luck by increasing the number of golden balls 64 in the dome by answering a question made by the host. If his answer is the right one, another golden ball is added and his odds are now increased to 5/1. The risk in answering a wrong answer is the addition of another black ball into the dome, a fact that decreases the contestant's odds. Each one of the golden balls pulled out from the dome is a wish comes through and a stamp is granted by the host in order to mark the credited wish. In any stage of the game, if the contestant pulls out a black ball, all his prizes are lost including the credited wishes. At any stage of the game, the contestant can decide whether to quit and take the wishes he has won so far or to continue on and risk losing all of the accumulated wishes.

Similarly to the book of wish game that is based on knowledge, an insurance mechanism 66 is offered in this preferred embodiment of the present invention, too. The contestant may insure one or more of his wishes; however, the price of the insurance is the addition of another black ball per each insured wish. The consequence of insuring many wishes is reducing the odds of pulling a golden ball. The ratio of golden balls to black balls is decreased.

This aspect of the present invention has also a part in which Internet users may participate in the game in the same manner as in the above-mentioned knowledge-based game. Studio audience participation also exists here, similar to the knowledge aspect.

In both the luck and knowledge aspects, after the first contestant finishes playing, either by quitting on his own or by disqualifying himself or by winning all 10 wishes, the next contestant is challenged, and so on, for as many contestants as time permits.

At the end of the book of wishes game in any aspect of the present invention, the prizes are transferred to the contestants, the external participants or the audience according to what happened in the game.

Any variation in the number of contestants, the number of wishes in the book of wishes, the number of questions, the number of topics, the number of balls from any color or any other possible variation in the format of the book of wishes game described herein, is covered by the scope of the present invention.

In another aspect of the present invention, the Internet site, which is interacting with the television version of the book of wishes game, is becoming an arena for commerce. Internet users may present their wishes while the wishes have to be of such a nature that they may be achieved in a monetary manner or any other simple way; examples of such wishes are products and services, meetings with celebrities, dinner in expansive restaurants and so on. One cannot wish, for example, for good health, world peace or happiness. If a user wish corresponds to a prize that is lost in a book of wishes game as explained before, the user may win his wish while the winning of ones wish is announced in the television show. If there are many Internet users that are competing over one prize, the Internet user who accumulates the most credit points will have greater odds to win the prize. An Internet user may increase his odds of winning desired wishes in the Internet site by participating in as many activities of the site as possible. Users who created their own personal wish list will receive, upon their approval, marketing and commercial information regarding their wishes. The Internet site acts as a location for interaction and commerce between suppliers, sellers and marketers and between people who desire to attain their products and services.

It should be clear that the description of the embodiments and attached Figures set forth in this specification serves only for a better understanding of the invention, without limiting its scope as covered by the following Claims.

It should also be clear that a person in the art, after reading the present specification could make adjustments or amendments to the attached Figures and above described embodiments that would still be covered by the following Claims.

The invention claimed is:

1. A method of playing a television game, played by a player chosen from a group of contenders, the method comprising:

asking each of the contenders before the game commences to provide a list of his or her own desired wishes that are executable, each list of desired wishes is prepared by each contender and recorded prior to the actual beginning of the game;

challenging the player with a number of challenges in a consecutive order, wherein upon the player meeting a challenge successfully he or she is credited with a wish chosen in a predetermined order from the list of desired wishes, and allowing the player to choose whether to quit and retain the awarded wishes or to be challenged again allowing him or her to be credited with another wish from the list of desired wishes, and wherein upon the player failing to meet a challenge he or she is disqualified and discredited of the wishes previously credited.

2. The method of claim 1, wherein after the player is disqualified a new player is invited to play the game and be credited with wishes from the list of desired wishes, that were either discredited from the player who played before the new player or were not previously credited.

3. The method of claim 2, wherein the new player is chosen if one or more wishes on the list of desired wishes is stated by the player to be a wish of his or her own.

4. The method of claim 2, wherein the new player is communicated with by using a communication network.

5. The method of claim 4, wherein the communication network is worldwide-web based.

6. The method of claim 1, wherein the challenges comprise drawing an item from a group of items, one of the items being a distinctly marked item, the player being made to be unable to identify the distinctly marked item prior to drawing an item, wherein drawing the distinctly marked item disqualifies the player, and wherein drawing an item that is not the distinctly marked item is considered to be meeting the challenge successfully, crediting the player with a wish and allowing him or her to be challenged again or quit.

7. The method of claim 6, wherein the group of items comprises balls.

8. The method of claim 6, wherein more than one distinctly marked item is used.

9. The method of claim 1, wherein the challenges comprise trivia questions.

10. The method of claim 1, wherein the challenges are arranged in groups of different topics.

11. The method of claim 10, wherein the player is allowed to select a topic from which to be challenged.

12. The method of claim 10, wherein the player is allowed a limited time to meet a challenge and is disqualified if he or she fails to meet the challenge in time.

13. The method of claim 1, wherein the player is allowed to refuse a challenge and be challenged by another challenge.

14. The method of claim 1, wherein to ensure that the player is awarded a credited wish even if the player fails to meet a challenge, the number of challenges with which he or she are challenged is reduced and the level of difficulty of a following challenge is increased.

15. The method of claim 1, wherein the player is allowed to pass on a challenge within a limited period of time, without being disqualified, subject to a penalty.

16. The method of claim 15, wherein the player has to activate a panic button mechanism to pass a challenge.

17. The method of claim 16, wherein the panic button mechanism may be activated within the limited period of time.

18. A method of playing a game, played by a player chosen from a group of contenders, the method comprising:

asking each contender before the game commences to provide a list of his or her own desired wishes that are executable, each list of desired wishes is prepared according to the will and desires of each contender prior to the actual beginning of the game; and challenging the player with at least one of a successive plurality of challenges in a predetermined order, the predetermined order of the plurality of challenges corresponding to a predetermined order of the list of wishes, wherein the player meeting a challenge successfully results in the player being credited with a corresponding wish in the predetermined order of the list of wishes.

19. The method of claim 18, further comprising:

allowing the player to choose whether to quit and retain any credited wish or to be challenged again with a further challenge in the predetermined order of challenges corresponding to a further wish from the predetermined order of the list of wishes, wherein the player meeting the further challenge successfully results in the player being credited with the further wish from the predetermined order of the list of wishes.

20. The method of claim 19, further comprising:

discrediting a player of any credited wish and the further wish when the player fails to meet the further challenge.

21. The method of claim 18, wherein the player failing to successfully meet the challenge results in the player being discredited of the corresponding wish from the predetermined order of the list of wishes.

22. The method of claim 21, further comprising:

disqualifying the player failing to successfully meet the challenge that resulted in the player being discredited of the corresponding wish from the predetermined order of the list of wishes; and inviting a new player to play the game and be challenged for a corresponding wish from the predetermined order of the list of wishes that were either discredited from a disqualified player or were not previously credited to a disqualified player.

23. The method of claim 22, further comprising:

communicating with the new player to play the game by using a communication network.

24. The method of claim 22, further comprising:

enabling the registration of a new player by using a communication network.

25. The method of claim 24, further comprising:

communicating with the new player to play the game by using a communication network.

26. The method of claim 22, further comprising:

choosing the new player based upon one or more wishes from the list of wishes being a wish of the new player.

27. The method of claim 26, further comprising:

communicating with the new player to play the game by using a communication network.

28. The method of claim 21, further comprising:

disqualifying the player failing to successfully meet the challenge that resulted in the player being discredited of the corresponding wish from the predetermined order of the list of wishes; and inviting a new player to play the game.

29. The method of claim 28, further comprising:

enabling the registration of a new player by using a communication network.

30. The method of claim 28, further comprising:

choosing the new player based upon one or more wishes from the list of wishes being a wish of the new player.

31. The method of claim 28, further comprising:

communicating with the new player to play the game by using a communication network.

32. The method of claim 31, wherein the game is a television game.

33. The method of claim 31, wherein the game is an interactive game.

34. The method of claim 18, wherein the game is a television game.

35. The method of claim 18, wherein the game is an interactive game.

36. The method of claim 18, further comprising:

communicating with a new player to play the game by using a communication network.

37. The method of claim 18, wherein the challenges comprise drawing an item from a group of items, one of the items being a distinctly marked item, the player being made to be unable to identify the distinctly marked item prior to drawing an item, wherein drawing the distinctly marked item disqualifies the player, and wherein drawing an item that is not the distinctly marked item is considered to be meeting the challenge successfully, crediting the player with a wish and allowing the player to be challenged again or quit.

38. The method of claim 37, wherein the group of items comprises balls.

39. The method of claim 37, wherein more than one distinctly marked item is used.

40. The method of claim 18, wherein the challenges comprise trivia questions.

41. The method of claim 18, wherein the challenges are arranged in groups of different topics.

42. The method of claim 41, wherein the player is allowed to select a topic from which to be challenged.

43. The method of claim 41, wherein the player is allowed a limited time to meet a challenge and is disqualified if he or she fails to meet the challenge in time.

44. The method of claim 18, wherein the player is allowed to refuse a challenge and be challenged by another challenge.

45. The method of claim 18, wherein to ensure that the player is awarded a credited wish even if the player fails to meet a challenge, the number of challenges with which the player is challenged is reduced and the level of difficulty of a following challenge is increased.

46. The method of claim 18, wherein the player is allowed to pass on a challenge within a limited period of time, without being disqualified, subject to a penalty.

47. The method of claim 46, wherein the player has to activate a panic button mechanism to pass a challenge.

48. The method of claim 47, wherein the panic button mechanism may be activated within the limited period of time.

* * * * *